US007621509B2

(12) United States Patent
Tardif

(10) Patent No.: US 7,621,509 B2
(45) Date of Patent: Nov. 24, 2009

(54) DEVICE FOR GUIDING THE BOLT ROPE OF A SAIL

(75) Inventor: Sebastien Tardif, Saint Nazaire (FR)

(73) Assignee: Wichard (FR)

( * ) Notice: Subject to any disclaimer, the term of this patent is extended or adjusted under 35 U.S.C. 154(b) by 127 days.

(21) Appl. No.: 11/719,328

(22) PCT Filed: Nov. 7, 2005

(86) PCT No.: PCT/FR2005/002771

§ 371 (c)(1),
(2), (4) Date: Feb. 20, 2008

(87) PCT Pub. No.: WO2006/051207

PCT Pub. Date: May 18, 2006

(65) Prior Publication Data

US 2009/0072208 A1 Mar. 19, 2009

(30) Foreign Application Priority Data

Nov. 15, 2004 (FR) ..... 04 12073

(51) Int. Cl.
*B66D 3/04* (2006.01)

(52) U.S. Cl. ..... 254/389; 114/105

(58) Field of Classification Search ..... 254/389; 114/105, 108, 102.1, 102.16
See application file for complete search history.

(56) References Cited

U.S. PATENT DOCUMENTS 3,658,025 A * 4/1972 Hood et al. ..... 114/105
3,802,373 A * 4/1974 Lagerquist ..... 114/105
3,948,200 A * 4/1976 Hood et al. ..... 114/105
4,340,005 A * 7/1982 Lagerquist ..... 114/105
4,573,424 A * 3/1986 Clausin ..... 114/106
4,619,216 A * 10/1986 Crear et al. ..... 114/105
6,634,311 B2 * 10/2003 Cudd et al. ..... 114/105
7,096,812 B1 * 8/2006 Cook et al. ..... 114/105
2003/0136323 A1 7/2003 Cudd, III et al.
2004/0079269 A1 4/2004 Cudd, III et al.

OTHER PUBLICATIONS

International Search Report; PCT/FR2005/002771; Mar. 3, 2006.

* cited by examiner

*Primary Examiner*—Emmanuel M Marcelo
(74) *Attorney, Agent, or Firm*—Cantor Colburn LLP

(57) ABSTRACT

The invention relates to a device for guiding the bolt rope of a sail. The inventive device (6) comprises two curved jaws (9, 10) which are fixed to one another around a pivot point (11). The first jaw (9) is equipped with an inward-facing extension (12) comprising a flat portion (13) and a recess (14). The second jaw comprises a U-shaped locking buckle which is mounted such that the ends thereof can pivot around a position of equilibrium. According to the invention, when the device is in the closed position, the middle portion of the buckle is engaged in the recess so that the jaws are held together and, when the device is in the open position, the middle portion of the buckle rests on the flat portion of the extension so that the jaws are kept at a distance from one another.

7 Claims, 2 Drawing Sheets

DEVICE FOR GUIDING THE BOLT ROPE OF A SAIL

BACKGROUND OF THE INVENTION AND DESCRIPTION OF THE PRIOR ART

The present invention relates to a device for guiding the bolt rope of a sail.

This invention particularly applies to the preguidance of a leech rope, for example that of a mainsail or jib, before its introduction into the slot of a mast or of a jib winder.

Known bolt rope preguides usually take the form of a rigid crescent-shaped part, its central portion being connected to a supporting member and its ends separated by a distance greater than the thickness of the sail so that the sail can run between its ends, and less than the thickness of the bolt rope so that the bolt rope cannot escape from the preguide when the sail is being run through it.

In order to feed the bolt rope into the preguide, therefore, one of its ends has to be inserted through the preguide. A major drawback with such devices is therefore the fact that when the user is hoisting his sail under conditions in which the loads are large (such as a strong wind), or when the bolt rope is in poor condition, and the rope escapes from the preguide, the user has to lower his sail completely to find the end of the bolt rope, pass this end back through the preguide and hoist the sail again.

The technical problem to be solved is how to provide a bolt rope preguide allowing rapid engagement and disengagement onto and off the bolt rope, at any point along the length of the latter.

SUMMARY OF THE INVENTION

The present invention solves this problem by providing a device for guiding the bolt rope of a sail, characterized in that it comprises two curved jaws connected together about a pivot point, the first jaw being provided with an extension leading inward and comprising a flat portion and a housing, the second jaw comprising a U-shaped locking loop made of steel wire connected to said second jaw by the two ends of the U and capable of pivoting with a spring action about a position of equilibrium in which:

- when the device is in the closed position, the central portion of the loop is removably engaged in the housing in order to keep the two jaws close together, separated by a distance less than the diameter of the bolt rope and greater than the thickness of the sail, and
- when the device is in the open position, the central portion of the loop rests on the flat portion of the extension in order to keep the two jaws separated from each other by a distance greater than the thickness of the bolt rope.

It is thus possible to engage the device around the bolt rope at any point along the length of the latter, for example when the bolt rope has accidentally escaped from the device, and to disengage the device from the bolt rope at any moment, if necessary.

Advantageously, the locking loop comprises two arms of unequal length whose ends have longitudinally separated pivoting points with respect to the second jaw.

This configuration of the two fixing points of the ends of the loop makes it possible to generate an elastic return action when the loop is moved to either side of its equilibrium position.

The device also comprises a recess defined by the two jaws between the pivot and the locking loop.

This recess allows an attachment element such as a rope to pass through it. The rope will be attached for example by two knots in the rope, one on either side of the device.

Lastly, the pivot point of the two jaws will advantageously be a rivet.

BRIEF DESCRIPTION OF THE DRAWINGS

A clear understanding of the invention will however be made possible by the following description, which refers to the attached diagrammatic drawing showing by way of non-restrictive example an embodiment of this preguide device for a sail bolt rope.

DESCRIPTION OF THE PREFERRED EMBODIMENT

Figure 1:
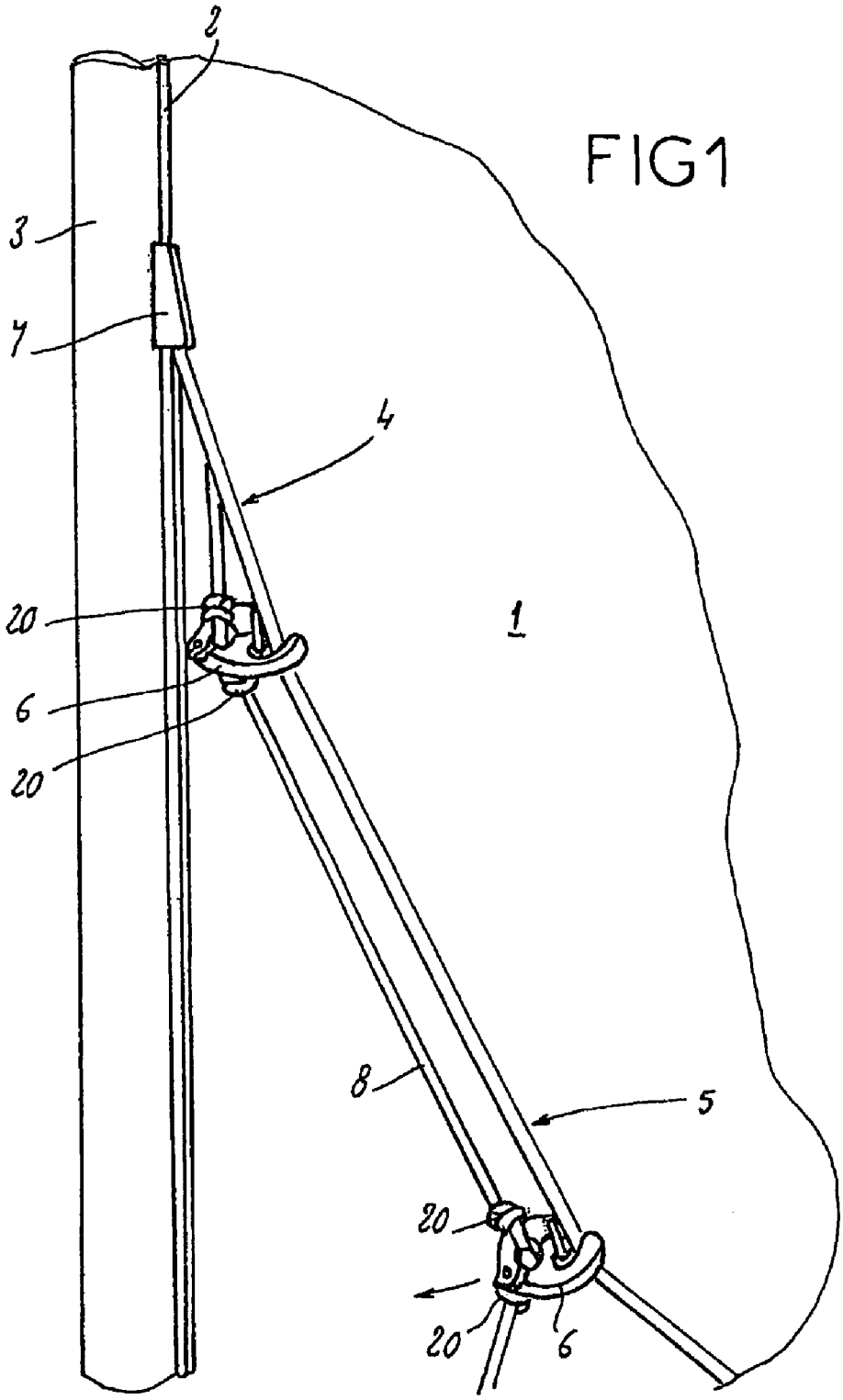
FIG. 1 is a partial side view of a sail engaged in two devices according to the invention.

FIG. 1 shows a mainsail 1 being hoisted in a sail supporting member formed by the bolt rope slot 2 of a mast 3, the leech 4 of which sail 1 is provided with a bolt rope 5 held by and sliding in two preguide devices 6 which help to guide the bolt rope 5 toward the slot 2.

As will be seen in FIG. 1, the lower end of the bolt rope slot 2 of the mast 3 has a bolt rope guide 7 secured to the mast 3. This device is known per se and will not be described in detail here.

Each device 6 is connected, in a manner which will be described later, at a distance from each other along a line 8—or rope—which is itself connected to the sail supporting member (which may be a mast, a winding tube, a hollow stay or the like). In most cases a single preguide is used for fitting a sail.

This line 8 pulls the preguides 6 and the free portion of the sail 1 toward the mast 3 as shown in FIG. 1 by an arrow, facilitating the insertion of the bolt rope 5 into the bolt rope slot 2 of the mast.

Figure 2:
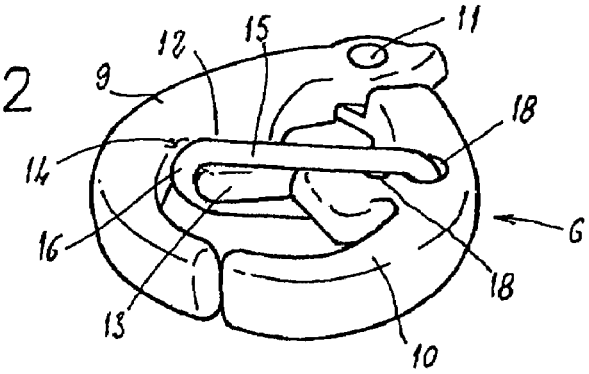
FIG. 2 is a perspective view of the device in the closed position.

As illustrated in FIG. 2, the bolt rope preguide device 6 according to the invention comprises two curved jaws 9, 10 connected together at one end of each about a pivot point 11 formed by a rivet.

The first jaw 9 is provided with an extension 12 leading inward and comprising a flat portion 13 and a housing 14. The second jaw 10 is fitted with a U-shaped wire locking loop 15 pivoted to the second jaw 10 by both of its ends, and pivoting elastically about an equilibrium position. To this end, the two pivoting points 18 of the ends of the arms are separated longitudinally.

When the locking rod 15 is in its position of elastic equilibrium, two configurations are possible for the device.

Figure 3:
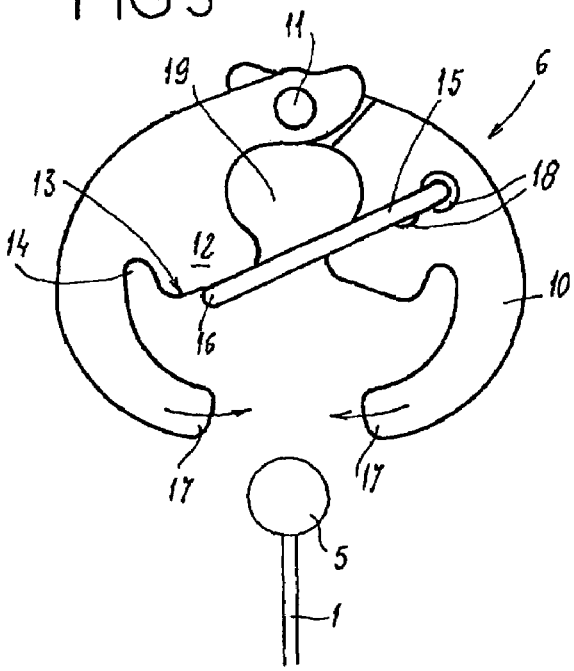
FIG. 3 is an elevation view in the open position.

When the device 6 is in the open position, as illustrated in FIG. 3, the central portion 16 of the rod 15 rests on the flat portion 13 of the extension 12 in order to keep the two jaws 9, 10 separated from each other by a distance greater than the diameter of the bolt rope 5.

Figure 4:
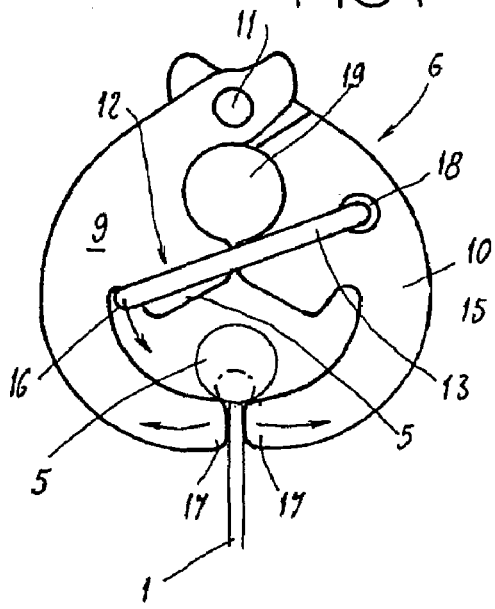
FIG. 4 is an elevation view in the closed position.

When the device 6 is in the closed position, as illustrated in FIG. 4, the central portion 16 of the rod 15 is engaged in the housing 14, in order to keep the two jaws 9, 10 close together, separated by a distance less than the diameter of the bolt rope 5 and greater than the thickness of the sail 1, so that the sail can run through the bolt rope preguide 6 but the bolt rope cannot escape from the space between the jaws 9, 10.

In order to close the device 6 when it is open, simple manual pressure on the outer faces of the jaws 9, 10 is sufficient, as shown by the arrows in FIG. 3.

To open the device 6 when it is closed, all that is required is to push the locking rod 15 by hand out of the locking housing 14—and therefore away from its position of elastic equilibrium—as shown by a thick arrow in FIG. 4, and then to separate the two ends 17 of the jaws 9, 10 by hand, as shown by single arrows in opposite directions in FIG. 4.

The elastic return spring action of the locking rod 15 to its equilibrium position is produced by the fact that the rod has two arms of unequal lengths whose ends have parallel pivoting axes 18 in the jaw to which they are connected, and these ends are separated longitudinally along the orientation of the rod 15.

The curved jaws 9, 10 of the device 6 of the invention have moreover a shape such that a closed recess 19 is formed between the two jaws 9, 10, the extension 12 and the locking rod 15. This space 19 can be used to hold the line 8—or rope—described earlier and illustrated in FIG. 1.

Each of the bolt rope preguide devices 6 according to the invention is prevented from sliding along the line 8 by knots 20 on either side of the corresponding device, as shown in FIG. 1, the diameter of these knots being greater than the diameter of the space 19 through which the line is passed.

It goes without saying that the invention is not limited to the one embodiment of the bolt rope preguide described above by way of example, and that it instead encompasses all variants thereof.

The invention claimed is:

1. A device for guiding a bolt rope of a sail into a sail supporting member, comprising:

two curved jaws connected together about a pivot point, the first jaw being provided with an extension leading inward and comprising a flat portion and a housing, the second jaw comprising a U-shaped locking loop made of steel wire connected to said second jaw by two ends of the U and capable of pivoting with a spring action about a position of equilibrium;

wherein, when the device is in a closed position, a central portion of the loop is removably engaged in the housing in order to keep the two jaws close together, separated by a distance less than a diameter of the bolt rope and greater than a thickness of the sail, and wherein, when the device is in an open position, the central portion of the loop rests on the flat portion of the extension in order to keep the two jaws separated from each other by a distance greater than a thickness of the bolt rope.

2. The device as claimed in claim 1, wherein the locking loop comprises two arms of unequal length whose ends have longitudinally separated pivoting points on the second jaw.

3. The device as claimed in claim 1, further comprising a recess defined by the two jaws between the pivot and the locking loop.

4. The device as claimed in claim 1, wherein the pivot point of the two jaws is a rivet.

5. The device as claimed in claim 2, further comprising a recess defined by the two jaws between the pivot and the locking loop.

6. The device as claimed in claim 2, wherein the pivot point of the two jaws is a rivet.

7. The device as claimed in claim 3, wherein the pivot point of the two jaws is a rivet.

* * * * *